United States Patent [19]

Fueki et al.

[11] 4,021,316

[45] May 3, 1977

[54] BATH FOR THE ELECTRODEPOSITION OF BRIGHT TIN-COBALT

[75] Inventors: Shimetomo Fueki, Tokyo; Junichi Tada, Yokohama; Kenji Osawa, Hino; Naomi Sakai; Kazuhiro Ogawa, both of Yokohama, all of Japan

[73] Assignee: Sony Corporation, Tokyo, Japan

[22] Filed: Aug. 21, 1975

[21] Appl. No.: 606,597

Related U.S. Application Data

[63] Continuation-in-part of Ser. No. 360,542, May 15, 1973, Pat. No. 3,914,160.

[30] Foreign Application Priority Data

May 17, 1972 Japan ..... 47-48181

[52] U.S. Cl. ..... 204/43 S

[51] Int. Cl.[2] ..... C25D 3/60

[58] Field of Search ..... 204/43 S, 43 T

[56] References Cited

UNITED STATES PATENTS 3,772,168 11/1973 Dillenberg ..... 204/43 S

OTHER PUBLICATIONS

Vasanta Sree et al., Bull. India Sect. Electro—Chem. Soc., 9, 13–14, (1960).

*Primary Examiner*—G. L. Kaplan
*Attorney, Agent, or Firm*—Lewis H. Eslinger; Alvin Sinderbrand

[57] ABSTRACT

Bright tin-cobalt alloy produced by electrodeposition from an aqueous pyrophosphate electroplating bath that contains a stannous salt, a cobalt salt and a brightener additive which is a combination of at least one water-soluble peptide and at least one of the group of ammonia, ammonium salts and amine compounds.

11 Claims, No Drawings

BATH FOR THE ELECTRODEPOSITION OF BRIGHT TIN-COBALT

CROSS REFERENCE TO RELATED APPLICATION

This application is a continuation-in-part of parent application Ser. No. 360,542 filed May 15, 1973, now U.S. Pat. No. 3,914,160.

FIELD OF THE INVENTION

This application is a continuation-in-part of parent application Ser. No. 360,542 filed May 15, 1973, now U.S. Pat. No. 3,914,160.

FIELD OF THE INVENTION

The present invention relates generally to bright tin-cobalt plating baths, and more particularly to bright tincobalt plating baths wit brightener additives.

DESCRIPTION OF THE PRIOR ART

In general, electroplated surfaces of tin alloys have superior anti-corrosive characteristics. Tin-nickel alloy plating is one of the tin alloys that has been used and that is superior in its anti-corrosive characteristics compared to a plating of tin or nickel alone. The tin-nickel alloy plating shows a reddish appearance. To carry out the tin-nickel alloy plating, an acidic fluoride bath is generally used, and the electroplated layer thus formed is very brittle and is apt to crack when stress is applied to it.

A pyrophosphate bath also has been proposed for tinnickel alloy plating, but the electroplataed layer thus formed is also brittle, and it is more difficult to control the pyrophosphate bath than it is to control the acidic fluoride bath. For this reason, the pyrophosphate bath is not used in practice.

Tin-colbalt alloy plating is also known, and is known to avoid the undesirable brittleness of tin-nickel alloy plating. Tin-cobalt alloy plating is substantially equal to tin-nickel alloy plating in its anti-corrosive characteristics but is substantially less brittle so that cracks are not as apt to form in tin-cobalt alloy plating.

As a practical tin-colbalt plating bath, an acidic fluoride bath is used, and the plating formed has a color about equal to that of chromium plating. Tin-cobalt alloy plating, therefore, can be employed as finishing plating in place of chromium plating which is usually employed. However, the tincobalt alloy plating bath containing fluoride requires difficult drainage and exhaust treatments and thus is undesirable from the point of view of environmental pollution and protection.

A report (Electrodeposition of Alloys, Vol. 2, Academic Press, New York and London, pp. 339–341, 1963, edited by A Brenner) has been issued by V. Sree and T.L. Rama Char on tin-cobalt alloy plating from a pyrophosphate bath. Based upon that report, the inventors of the present invention have carried out a test in which ammonium citrate is added to the pyrophosphate bath as an additive, as disclosed in the report. Throughout this test, the contents of the bath were agitated to carry out a socalled Hull Cell Test. The electroplated coating formed by this test had black or grey blurs.

OBJECTS AND SUMMARY OF THE INVENTION

An object of the present invention is to provide a bath for electrodeposition of tin-cobalt alloy capable of producing a white bright tin-cobalt plating layer without the use of fluoride.

Another object of the present invention is to provide an aqueous plating bath containing pyrophosphate, stannous salt and cobalt salt for plating a white bright tin-cobalt alloy by electrodeposition.

A further object of the present invention is to provide a brighter additive for an electroplating bath consisting of stannous salt, cobalt salt and alkali metal pyrophosphate.

These and other objects of the present invention can be attained by aqueous electroplating baths consisting of alkali metal pyrophosphate, stannous salt, cobalt salt and a brightener additive that is at least one water-soluble peptide together with one or more of the group ammonia, ammonium salt or amine compound.

DETAILED DESCRIPTION AND PREFERRED EMBODIMENTS

In accordance with the present invention, the brightener additive is the combination of one or more water-soluble peptides such as glue, gelatin and peptone used together with one or more of the group consisting of ammonia, ammonium salt and amine compound.

To make an alloy plating bath including tin, cobalt and alkali metal pyrophosphates, tin pyrophosphate can easily be dissolved in an aqueous solution of potassium pyrophosphate. Cobalt pyrophosphate, however, is hardly dissolved in such an aqueous solution, even at a temperature of 60° to 80° C., when the weight of cobalt pyrophosphate is greater than the weight of potassium pyrophosphate. Other salts of cobalt such as cobalt chloride, cobalt sulfate and cobalt nitrate, however, are readily soluble in such an aqueous solution irrespective of the potassium pyrophosphate concentration.

A typical electroplating bath according to the present invention can be prepared as follows:

An aqueous cobalt salt and potassium pyrophosphate bath is made. If cobalt pyrophosphate salt is used, more than about 15 parts by weight of the potassium pyrophosphate salt should be used per part of the cobalt pyrophosphate. If one of the readily-soluble cobalt salts is used, it can be added as an aqueous solution of up to about 40 percent strength to potassium pyrophosphate solution at about 60 C. with agitation for dissolution therein. Aqueous stannous pyrophosphate solution is then added with agitation to the bath thus formed for of the resulting alloy plating electrolyte are high in stability so that with the addition of the brightener, as hereinafter described in detail, a bright tin-cobalt alloy plating is obtained merely with mechanical agitation and without any accompanying void electrolyzing.

The cobalt salt is preferably selected from cobalt sulfate, cobalt nitrate, cobalt chloride, cobalt bromide, cobalt carbonate, cobalt acetate, ethylene diamine tetraacetic acid cobalt, cobalt (II) acetyl acetonate, cobalt (III) acetyl acetonate, glycine cobalt (III) and cobalt pyrophosphate.

The components of the electrolyte according to the present invention are employed within the following concentration ranges: the stannous metal is used as a solution of about 2 to about 70 g/1, preferably about 5 to about 15 g/1; the cobalt metal is used as a solution about 1 to about 40 g/1, preferably about 1.5 to about 15 g/1; the total metal concentration is below about 75 g/1, preferably below about 30 g/1; and the amount of potassium pyrophosphate is more than about twice the molar amount of the total amount of tin and cobalt ions but not more than about 2 mols per liter, preferably less than about 1.2 mol/1.

The water-soluble peptide part of the brightener additive, including glue, gelatin, peptone, derived protein and gluten, is added to the plating bath of this invention in an amount of about 0.1 to about 80 g/1, preferably about 1 to about 20 g/1. With a lesser amount, little if any brightening effect is obtained; with a greater amount, little if any increase is ascertained in the brightening effect. Such water-soluble peptides are added to the bath after being dissolved in water, aqueous caustic alkali solution, aqueous potassium pyrophosphate solution or alcohols, such as methanol, ethanol and the like.

The ammonia, ammonium salt and amine compound parts of the brightener additive added to the plating bath in combination with the water-soluble peptide ae preferably selected from the group comprised of ammonium hydroxide (aqueous ammonia solution), ammonium chloride, ammonium citrate, ammonium tartrate, ammonium sulfate, ammonium acetate, ethylenediamine, 1, 2-propanediamine, 1, 3- propanediamine, 1, 4-butanediamine, hydroxylamine hydrochloride, hydrazine, methylamine, ethylamine, propylamine, butylamine, piperazine, pyrrolidine, monoethanolamine, diethanolamine and triethanolamine. The necessary amount of ammonia, Usually added as 28 weight percent aqueous ammonia solution, is from about 5 to 25 grams, calculated as ammonia gas, per liter of the plating bath, and the necessary amount of the ammonium salts and amines compounds is about 0.1 to about 150 g/1, preferably about 0.5 to about 40 g/1.

The plating conditions according to the instant invention are: pH of about 8.0 to about 12.0, preferably about 8.0 to about 10.0; temperature of about 20° to about 70° C.; and current density of about 0.1 to about 4.0 A/dm², preferably about 0.1 to about 2.0 A/dm². The plating baths of this invention are found to be more effective when subjected to mechanical agitation, cathode rocking or a combination thereof during plating.

Bright tin-cobalt alloy platings formed by the plating baths of the present invention have an appearance similar to that of chromium plating and are superior in anticorrosive characteristic so that even upon exposure to atmosphere for about thirty days no color change or corrosion appears at portions human fingers have touched. Further, even a brine solution sprayed against the plated surfaces of this invention produces no changes in about 72 hours. Bending a test piece having a plated layer thereon according to this invention repeatedly through about 90° by a tester of 4 mm bending radius, the plated layer does not peel off or powder. The hardness of the platings is in the order of 500 on the Vicker's hardness scale.

The following Examples 1through 8serve to illustrate embodiments of the invention:

| | | Example | | | | | | | |
|---|---|---|---|---|---|---|---|---|---|
| | | 1 | 2 | 3 | 4 | 5 | 6 | 7 | 8 |
| potassium pyrophosphate | g/l | 250 | 250 | 250 | 250 | 250 | 250 | 250 | 250 |
| tin pyrophosphate | g/l | 15 | 15 | 15 | 15 | 15 | 15 | 15 | 15 |
| cobalt chloride | g/l | 30 | 30 | 30 | | | 30 | 30 | |
| cobalt sulfate | g/l | | | | 35 | | | | 35 |
| cobalt acetate | g/l | | | | | 30 | | | |
| water solution of ammonia 28% | cc/l | 70 | 70 | | 70 | | 20 | | |
| ammonium citrate | g/l | | | | | | | | 20 |
| 1,3-propanediamine | g/l | | | 3 | | 3 | | 1 | |
| glue | g/l | 1 | | | | | | | |
| gelatin | g/l | | 1 | | 1 | 1 | 4 | 1 | |
| peptone | g/l | | | 1 | | | | | 12 |
| pH | | 10.0 | " | " | " | " | " | " | " |
| temperature | ° C | 55 | " | " | " | " | " | " | " |
| cathode rocker | | exist | " | " | " | " | " | " | " |
| current density | A/dm² | 0.5–2 | " | " | " | " | " | " | " |
| amount of contained educed tin | % | 80.5 | 80.3 | 81.4 | 80.8 | 80.5 | 80.3 | 81.1 | 83.5 |
| appearance | | white bright | " | " | " | " | " | " | " |
| anode | | carbon | " | " | " | " | " | " | " |

The glue used in this experiment was obtained by hydrolysis of the hide of pig in boiling water, the gelatin used was obtained by hydrolysis of the proteins of the bones of calf in boiling water, and the peptone used was obtained by hydrolysis of milk casein with an enzyme.

Examples 1 to 8 show that white bright tin-cobalt alloy plating formed in the pyrophosphate bath is obtained by using, as the additive, a combination of ammonia, ammonium salt or amine compound with a water-soluble peptide.

The advantages of the bright tin-cobalt plating electrolyte of the present invention are summarized as follows:

1. Drainage and exhaust treatments are easily achieved because fluoride is not used in the bath.

2. Electroplating can be carried out at room temperature or somewhat above, in contrast to using fluoride baths which require temperatures of 65° C., and thus, electroplating according to the invention can be applied to plastics.

3. If the electroplating has a thickness of more than 10 microns, it shows an appearance similar to that of chromium plating, to which it is superior in anti-corrosive characteristic, and is not brittle. As a result, the electroplating can be used for both finishing and base plating.

4. The electroplating is very smooth at its marginal edges and, even if it has a thickness of 1 to 3 microns on a non-conductive material base with a relatively low current density of 0.1 to 1 amperes/dm², the electroplating has a high anti-corrosive characteristics and a fine appearance. The electroplating is suitable for those applications where chromium plating cannot be employed.

5. The electroplating can be applied to electronic parts, acoustic devices, optical devices, precision apparatus, parts for automobiles and ornaments.

It will be apparent that many variations and changes can be effected without departing from the scope of the present invention as disclosed herein and defined in te claims hereafter.

What is claimed is:

1. A bath for bright tin-cobalt alloy electroplating consisting essentially of an aqueous alkaline solution of:

a. a stannous salt present in an amount sufficient to provide approximately from 2 to 70 grams of tin metal per liter of said solution, b. a cobalt salt present in an amount sufficient to provide approximately from 1 to 40 grams of cobalt metal per liter of said solution, with the total amount of said tin and cobalt metals being less than 75 grams per liter of said solution, c. an alkali metal pyrophosphate present in an amount more than twice the molar amount of said total amount of said tin and cobalt metals but not more than 2 mols per liter of said solution, and d. a brightener additive consisting of at least one water-soluble peptide and at least one substance selected from the group consisting of ammonia, ammonium salts and amine compounds, said water-soluble peptide being present in an amount of approximately from 0.1 to 80 grams per liter of said solution, and said substance, when selected to be ammonia, being present in an amount of approximately 5 to 25 grams, calculated as ammonia gas, per liter of said solution, and, when selected from said ammonium salts and amine compounds, being present in an amount of approximately from 0.1 to 150 grams per liter of said solution.

2. A bath for bright tin-cobalt alloy electroplating according to claim 1; wherein the amount of said stannous salt is from about 5 to about 15 grams of tin metal per liter, the amount of said cobalt salt is from about 1.5 to about 15 grams of cobalt metal per liter, the total amount of said tin and cobalt metals is less than about 30 grams per liter, and the number of said alkali metal pyrophosphate is more than about twice the molar amount of the total amount of said tin and cobalt metals but less than about 1.2 mols per liter, said liter being of said aqueous solution plating bath.

3. A bath for bright tin-cobalt alloy electroplating according to claim 1; in which said substance, when selected from said ammonium salts and amine compounds, is present in an amount of approximately from 0.5 to 40 grams per liter of said solution.

4. A bath for bright tin-cobalt alloy electroplating according to claim 1; wherein the amount of said water-soluble peptides is from about 1 to about 20 grams per liter of said aqueous solution.

5. A bath for bright tin-cobalt alloy electroplating according to claim 1 wherein said stannous salt is tin (II) pyrophosphate.

6. A bath for bright tin-cobalt alloy electroplating according to claim 1 wherein said cobalt salt is selected from the group consisting of cobalt sulfate, cobalt nitrate, cobalt chloride, cobalt bromide, ethylene diamine tetraacetic acid cobalt, cobalt (II) acetyl acetonate, cobalt (III) acetyl acetonate, glycine cobalt (III) and cobalt pyrophosphate.

7. A bath for bright tin-coblat alloy electroplating according to claim 1 wherein said alkali metal pyrophosphate is potassium pyrophosphate.

8. A bath for bright tin-cobalt alloy electroplating according to claim 1 wherein said ammonium salt is selected from the group consisting of ammonium chloride, ammonium citrate, ammonium tartrate, ammonium sulfate and ammonium acetate.

9. A bath for bright tin-cobalt alloy electroplating according to claim 1 wherein said amine compound is selected from the group consisting of ethylendiamine, 1, 2-propanediamine, 1, 3-propanediamine, 1, 4-butanediamine, hydroxylamine-hydrochloride, hydrazine, methylamine, ethylamine, propylamine, butylamine, piperazine, pyrrolidine, monoethanolamine, diethanolamine ad triethanolamine.

10. A bath for bright tin-cobalt alloy electroplating according to claim 1 wherein said water-soluble peptide is selected from the group consisting of glue, gelatin, peptone, and gluten.

11. A bath for bright tin-cobalt alloy electroplating according to claim 1 wherein said water-soluble peptide is selected from the group consisting of glue from the hide of pig, gelatin from the bone of calf, and peptone from milk casein.

* * * * *